United States Patent [19]

Bergstrasser

[11] 4,285,085

[45] Aug. 25, 1981

[54] CEMENTING PRESS

[75] Inventor: Werner Bergstrasser, Rodermark, Fed. Rep. of Germany

[73] Assignee: USM Corporation, Farmington, Conn.

[21] Appl. No.: 138,760

[22] Filed: Apr. 10, 1980

[30] Foreign Application Priority Data

Apr. 23, 1979 [DE] Fed. Rep. of Germany ..... 2916308

[51] Int. Cl.[3] ..... A43D 63/00

[52] U.S. Cl. ..... 12/16.4

[58] Field of Search ..... 12/16.1, 16.2, 16.3, 12/16.4

[56] References Cited

U.S. PATENT DOCUMENTS

| | | | |
|---|---|---|---|
| 3,081,469 | 3/1963 | Muhlbach | 12/16.4 |
| 3,092,860 | 6/1963 | Haas | 12/16.4 |

*Primary Examiner*—Patrick D. Lawson

*Attorney, Agent, or Firm*—Owen J. Meegan

[57] ABSTRACT

A cementing press for attaching outsoles to lasted footwear including a counter support and a heel abutment formed of two interlockable portions, one of which is engagable with a lever attached to a heel support, the heel support being abuttable against the heel of the shoe being cemented.

5 Claims, 4 Drawing Figures

CEMENTING PRESS

BACKGROUND OF THE INVENTION

The present invention relates to a cementing press for attaching outsoles to lasted footwear from the toe to the lower end of the heel breast by using a counter support which supplies pressure in the waist region. In this way, the heel support takes up the pressure exerted upon the heel breast during the attachment cycle. The heel support is arranged on a lever which is pivoted around a fulcrum that is located transversely to the longitudinal direction of the shoe and at the side of the heel. It is provided with a lifting mechanism for a heel abutment and includes a catch pin which engages with an inclined slot in the lever in such a way that the lever together with the heel support is drawn up against the heel by the lifting motion of the heel abutment. A cementing press of this kind is disclosed in the co-pending application of Anton Muhlbach, Ser. No. 114,120, filed Jan. 21, 1980, said application being assigned to the same assignee as the present application.

SUMMARY OF THE INVENTION

The cementing press of the present invention offers the choice of two working methods. When a catch pin is inserted, the heel support can be drawn up against the heel by the motion of a lifting mechanism for the heel abutment so as to exert a pressure directed lengthwise onto the heel of the shoe from the rear by means of the heel support without bringing the heel abutment into operation. This method is suitable for cement-attaching outsoles to ladies shoes in which the outsole extends from the toe of the shoe to the lower end of the front of the heel. On the other hand, the cementing press offers an alternative method of operation in which the heel abutment is brought into operation on its own without involving the heel support. In that case the catch pin is withdrawn so that the heel support does not engage the heel by the motion of the lifting mechanism for the heel abutment. This alternative method presses a heel against an appropriately made up shoe by means of the heel abutment. It is mainly suitable for use in the manufacture of mens shoes.

According to the present invention, the use of the above-described cementing press can be enlarged so that it offers technique by which the heel support and the heel abutment are brought jointly into operation. The sole unit can be pressed by means of the heel which is already affixed to the outsole. In this way the sole is pressed against the appropriately made up shoe by means of the heel abutment and the heel support so that the heel is firmly held in its correct position during the procedure.

Also, according to the present invention, the heel abutment is divided into two parts with a front heel abutment portion facing the waist and a rear heel abutment portion facing the heel support. The rear abutment portion facilitates the fitting of a catch pin and the front and rear abutment portion are each provided with lifting mechanisms suitable for coupling separately.

Because of the division of the heel abutment into front and rear portions, the heel support may be operated in the manner described above by means of the rear abutment portion upon insertion of the catch pin. Although the front abutment portion remains operative regardless of the rear abutment portion and consequently is able to exert a pressure onto the heel, the application of pressure depends on the lifting mechanism of the front abutment portion. This means that the movement of the rear abutment portion, which is stopped upon the heel support abutting the heel, need not be utilized for exerting pressure onto the heel and the exertion of pressure is left exclusively to the front abutment portion. The synchronization of the correct pressure of the heel support and the heel abutment would be difficult if the heel abutment was not separated as this depends on the thickness and the height of the heel used at the time.

The attaching press designed according to the present invention has the advantage that the rear abutment portion is lockable in its rest position. Since it is lockable, it gives the effect that neither the rear abutment portion nor the heel support can be moved so that a pressure upon the heel can be exerted only by the front abutment portion. This feature is advantageous when attaching certain shape heels because high pressure will not be exerted upon them. Accordingly, the catch is designed as an optionally usable pin which serves both as a means for coupling the two abutment portions and also as a means for locking the rear abutment portion. When used for coupling, the pin is inserted into aligned bore holes provided in the two abutment portions. On the other hand, when used for locking, the pin is inserted into aligned bore holes provided in the rear abutment portion and in the frame.

DESCRIPTION OF THE PREFERRED EMBODIMENTS

Figure 1:
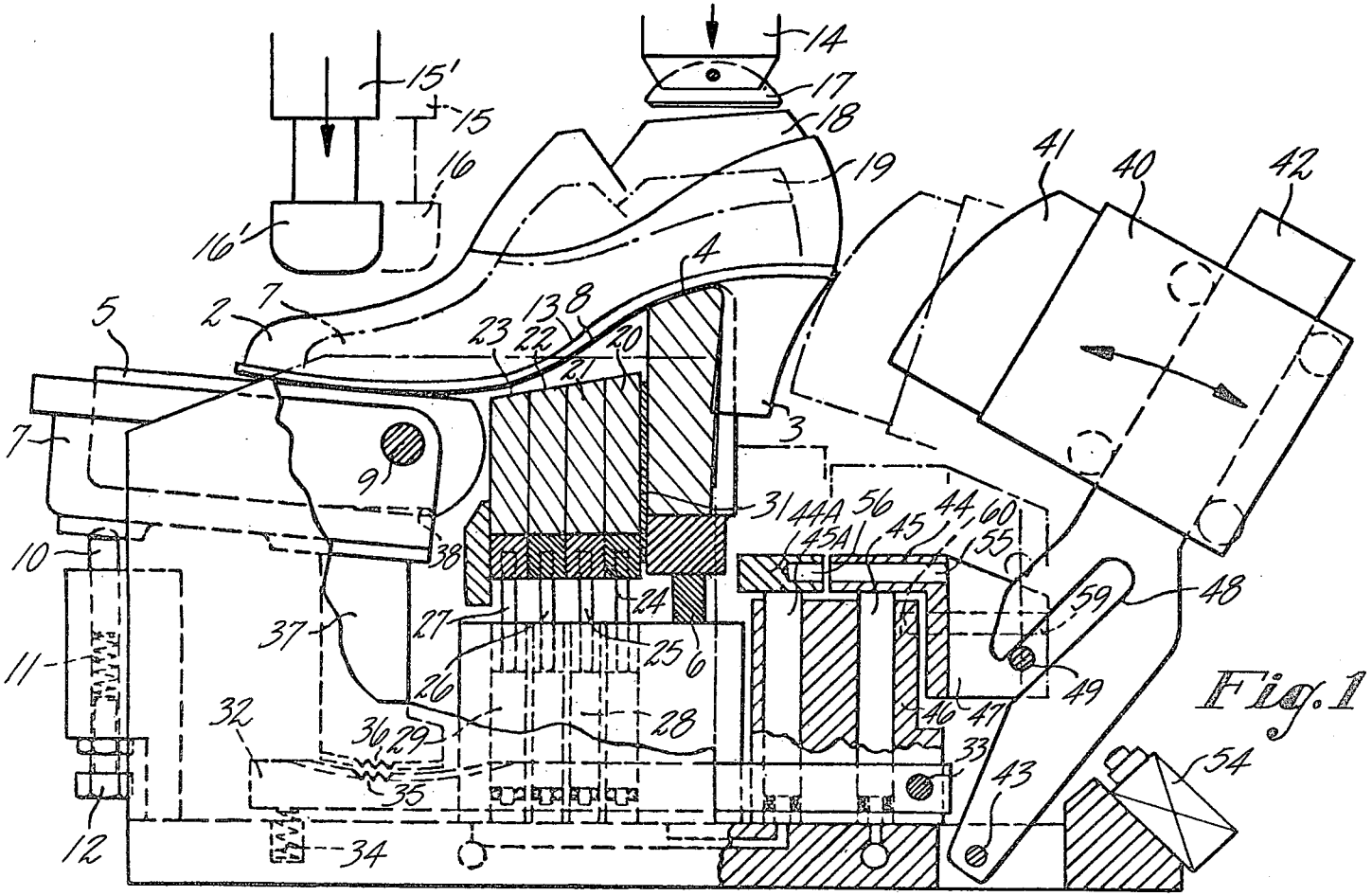
FIG. 1 is a side elevational view, partially in cross-section, of the cementing press with the front and rear abutment portion being uncoupled from each other whereby the heel support can be operated by means of the catch pin.

The method of operating the cementing press shown in FIG. 1 is disclosed in the previously mentioned co-pending application Ser. No. 114,120, filed Jan. 21, 1980, except for the heel abutment of the present invention. The heel abutment is formed of two portions, a front 44*a* and a rear 44, each of the portions being mounted on its own hydraulic piston 45*a*, 45. These hydraulic pistons are connected in a conventional manner to a hydraulic system.

Rear abutment portion 44 is provided with a fork 47 (one prong of which is shown in the drawing) to effect the swinging movement of lever 42. Lever 42 extends between the two prongs of fork 47 and is provided with inclined slot 48. The cylindrical pin 49 (located in the two prongs of fork 47) can enter into slot 48 and act as a catch. When the rear abutment portion 44 together with fork 47 is raised, the pin 49 will be carried with it. Pin 49 will enter the inclined portion of slot 48 and force lever 42 to swing around its fulcrum 43 in a direction towards the shoe 1 until the pad 41 abuts heel 3 and exerts pressure thereupon. The lifting mechanism for the rear abutment 44 thus provides the required swinging movement to heel support 42 and an independent drive mechanism for such movement is not required.

Such operation involves extension of the front and rear abutment portions (44*a* and 44 respectively) at the same time so as to initiate the swinging movement of the heel support together with lever 42. The upward movement of the rear abutment portion 44 is then halted when the pad 41 ceases its forward movement by engaging the heel 3. The rear abutment portion 44 ceases its upward motion and the position shown in dotted lines is achieved. The front abutment portion 44*a*, however, experiences no resistence and moves upwardly until reaching its end position, also shown in dotted lines. Such position may be somewhat higher than the position of the rear abutment portion. Cessation of the upward movement of the front abutment portion 40*a* is achieved through a stop (not shown) as is commonly used with piston/cylinder devices.

Figure 2:
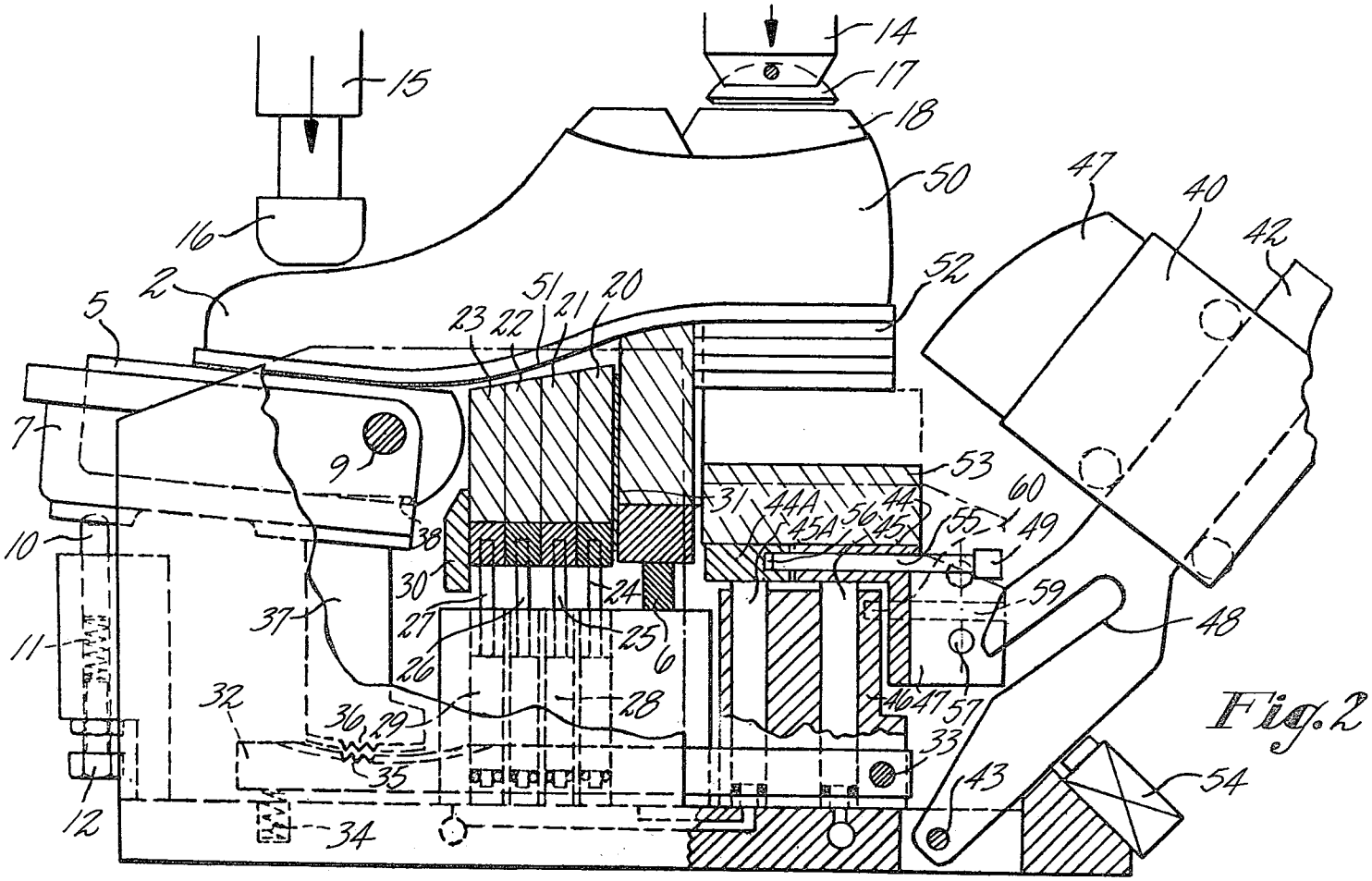
FIG. 2 is a similar view of the cementing press with the front and rear abutment portions being coupled with one another whereby the heel support is not operative.

FIG. 2 corresponds to FIG. 2 of the co-pending application Ser. No. 114,120, filed Jan. 21, 1980. In this procedure the shoe 50 is processed by cementing heel 52 and outsole 51 to the shoe, although it is possible to cement a heel only onto a correspondingly made up outsole attached to a shoe. The support of the heel 52 is provided by both the front and rear abutment portions, 44*a* and 44 respectively, which for this purpose are coupled together. Coupling is accomplished by the pin 49 which is inserted into the bore 55 of the rear abutment portion 44 and also into the bore 56 of the front abutment portion 44*a*. The two bores align with one another in the rest position as indicated by the continuous lines so that the pin 49 can be inserted easily into both bores. The pin 49 in this case is advantageously used for the coupling as it is not required to be used as a catch for the operation of lever 42 and therefore the abutment of pad 41. It is withdrawn from its position illustrated in FIG. 1 and inserted into the bores 55 and 56. Vacant bore 57 corresponds to the bore in the fork 47 of FIG. 1. Because pin 49 has been removed from the bore 47, the lever 42 is not actuated when the rear abutment portion 44*a* is advanced upwardly. Since the front abutment portion 44*a* and the rear abutment portion 44 are coupled together, they extend upwardly as a unit and thus form a closed heel abutment which acts in the same way as was described in connection with FIG. 2 of the co-pending application mentioned above.

Figure 3:
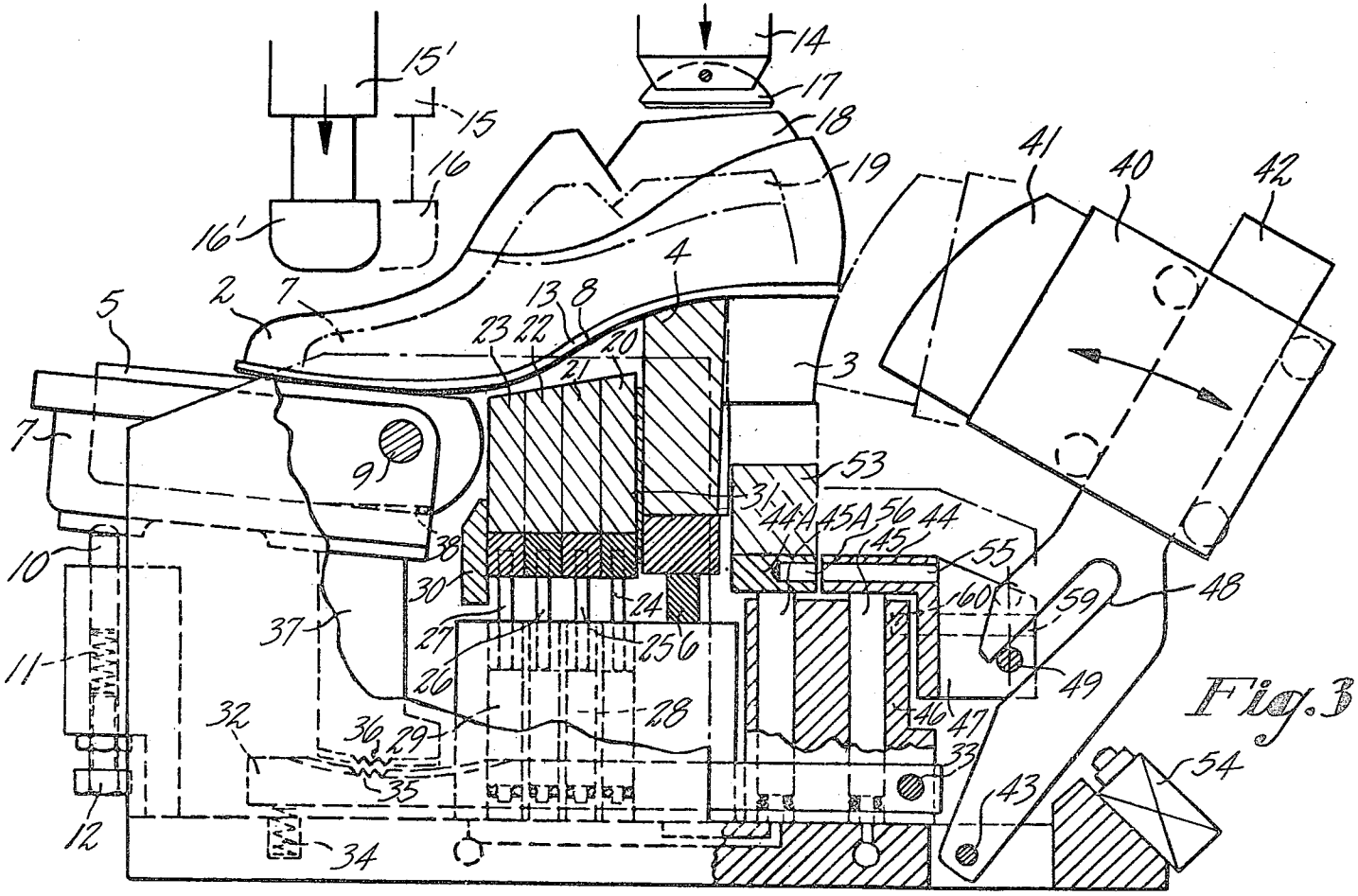
FIG. 3 is a similar view of the cementing press with the front and rear abutment portions uncoupled but with the heel support in an operative arrangement.

To combine a pressure on a part of the heel support and also on a part of the heel abutment, 44*a* and 44, the pin 49 is disposed as shown in FIG. 3 in a position as illustrated in FIG. 1 so that the pad 41 is drawn up against the shoe 2 upon the lifting movement of the rear abutment portion 44. According to FIG. 3, a rubber pad 53 is placed onto the front abutment portion 44*a* which is extended into a position as indicated by the dotted lines upon lifting of the front abutment portion 44*a* to press against the heel from the bottom. As can be seen, the front abutment portion 44*a* and the rear abutment portion 44 extends to different elevations. Either pad 41 or pad 58 comes into contact with the heel and whether one of these pads or the other contacts the heel is determined by the thickness and height thereof. It is therefore possible to simultaneously apply a pressure to heel 3 from the rear by means of pad 41 and also apply pressure from the bottom by means of pad 58. This method of operation is particularly suitable for heels which are sensitive to pressure.

Figure 4:
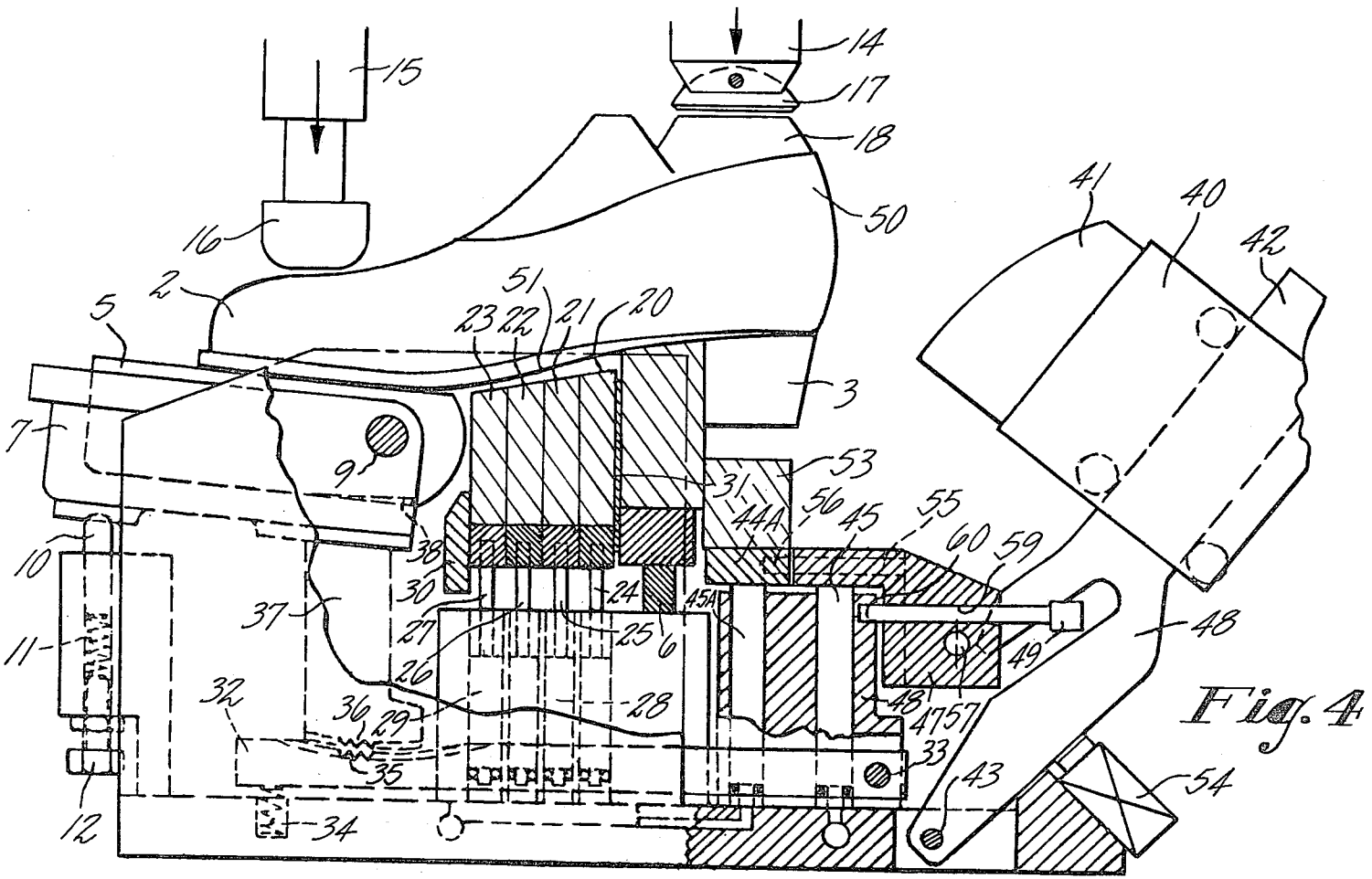
FIG. 4 is a similar view of the cementing press with the rear abutment portion being locked whereby the heel support is not operative.

If the heel support is not to be exposed to pressure then the method of operation shown in FIG. 4 may be utilized. In this case, the pin 49 is withdrawn from bore 47 and inserted into the bore 59 in the fork 47 and into the bore 60 in the housing 46. Both bores 59 and 60 align with one another in the drawn rest position. Thus the pin 49 locks the rear abutment portion 44. Because of the location of pin 49 in the two bores 59 and 60, the rear abutment portion 44 cannot extend upwardly. The pin located in bores 59 and 60 is not shown in FIG. 4 so as to provide an illustratively clear view. Thus only the front abutment portion 44*a* can extend upwardly which then presses against the heel 3 by means of the rubber pad 58 placed upon it. The method of operation is most frequently used if the heel has an adequate rigidity and does not require additional support for attachment.

Upon placing a higher rubber pad onto the front abutment portion 44*a* an outsole can also be cemented to the sole 2. The outsole, without a heel, covers the heel seat either wholly or partially. When attaching the outsole in this way the heel can be affixed later.

It is apparent that modifications and changes can be made within the spirit and scope of my invention but it is my intention only to be limited by the spirit and scope of the appended claims.

Having thus described my invention, what I claim as new and desire to secure by Letters Patent of the United States is:

1. A cementing press for cement attaching of outsoles to lasted footwear from their toe to the lower end of the heel breast by using a counter support for applying pressure in the waist region whereby a heel support is arranged to take pressure exerted on the heel breast during cement attaching, said heel support being arranged on a lever pivoted around a fulcrum located transversely to the longitudinal direction of the shoe and the side of the heel, said heel support being further provided with a lifting mechanism for a heel abutment receivable of a catch, said catch being engagable of an inclined slot in said lever so that the lever and the heel support are drawn up against the heel by the lifting motion of the heel abutment, the improvement which comprises;

said heel abutment being divided into a front portion facing the waist and rear portion facing the heel support whereby the rear heel abutment portion facilitates the fitting of said catch and the front abutment portion and the rear abutment portion are provided with lifting mechanisms suitable for separate coupling.

2. The cementing press according to claim 1 wherein the rear heel includes an operably usable pin which serves as a means for coupling the two heel abutment portions and also serves to lock the rear heel abutment portion.

3. The cementing press according to claim 1 or 2 wherein the catch includes an operably usable pin which serves as a means for coupling the two heel abutment portions and also serves to lock the rear heel abutment portion.

4. The cementing press according to claim 3 wherein the pin is adapted to be inserted into bores aligned with one another, said bores being disposed in the two heel abutment portions.

5. The cementing press according to claim 3 wherein the pin is insertable into bores disposed in the rear abutment portion and the frame of the press.

* * * * *